US012611053B2

(12) United States Patent
Delorenzo et al.

(10) Patent No.: US 12,611,053 B2
(45) Date of Patent: Apr. 28, 2026

(54) REFRIGERATED PREPARATION TABLE SYSTEM AND METHODS THEREOF

(71) Applicant: Electrolux Professional, Inc., Vicksburg, MS (US)

(72) Inventors: Orindo Delorenzo, Mount Pleasant, MI (US); Arthur Delorenzo, Mount Pleasant, MI (US); Jim Ervin, Lake Isabella, MI (US)

(73) Assignee: ELECTROLUX PROFESSIONAL, INC., Vicksburg, MS (US)

( * ) Notice: Subject to any disclaimer, the term of this patent is extended or adjusted under 35 U.S.C. 154(b) by 431 days.

(21) Appl. No.: 18/137,903

(22) Filed: Apr. 21, 2023

(65) Prior Publication Data

US 2023/0404295 A1 Dec. 21, 2023

Related U.S. Application Data

(63) Continuation of application No. 17/027,565, filed on Sep. 21, 2020, now Pat. No. 11,633,050.

(60) Provisional application No. 63/080,316, filed on Sep. 18, 2020, provisional application No. 62/903,610, filed on Sep. 20, 2019.

(51) Int. Cl.

| | |
|---|---|
| ***A47F 3/04*** | (2006.01) |
| ***A47B 77/02*** | (2006.01) |
| ***A47B 77/08*** | (2006.01) |
| ***A47B 77/16*** | (2006.01) |
| ***A47B 77/18*** | (2006.01) |

(52) U.S. Cl.

CPC ..... *A47F 3/0486* (2013.01); *A47B 77/022* (2013.01); *A47B 77/08* (2013.01); *A47B 77/16* (2013.01); *A47B 77/18* (2013.01)

(58) Field of Classification Search

CPC ..... A47F 3/0486; A47F 10/06; A47B 77/022; A47B 77/08; A47B 77/16; A47B 77/18

USPC ..... 426/231

See application file for complete search history.

(56) References Cited

U.S. PATENT DOCUMENTS

| | | | |
|---|---|---|---|
| 3,536,000 | A | 10/1970 | Whitehill |
| 3,972,318 | A | 8/1976 | Lenoir |
| 6,384,381 | B2 | 5/2002 | Witt et al. |
| 7,038,172 | B1 | 5/2006 | Stuck |

(Continued)

OTHER PUBLICATIONS

"Ex Parte Quayle Action Received For Design U.S. Appl. No. 29/708,816, mailed on Jan. 24, 2022."

(Continued)

*Primary Examiner* — Matthew W Ing

(74) *Attorney, Agent, or Firm* — Kutak Rock LLP

(57) ABSTRACT

A preparation table is provided. The preparation table includes a cabinet with a work surface. The work surface includes a perimeter which defines a cavity of the cabinet. Opposing guide structures proximate opposing perimeter walls are configured to support a grate. The grate can be movable or stationary but is configured to support a product or product container while still providing access to the cavity. The product container is movable on the work surface to both rear and forward positions. The cabinet is configured such that excess ingredients fall from the product container, through the grate, and are recaptured within the cavity. The cabinet also includes a transition element which provides support for the product container as it is moved to an adjacent work surface.

20 Claims, 9 Drawing Sheets

(56) References Cited

U.S. PATENT DOCUMENTS

| | | | | |
|---|---|---|---|---|
| 9,211,035 | B2 | 12/2015 | Shilling | |
| 10,045,829 | B1 | 8/2018 | Norman | |
| D924,006 | S | 7/2021 | Gillespie et al. | |
| D931,049 | S | 9/2021 | Bertness et al. | |
| D960,641 | S | 8/2022 | Delorenzo et al. | |
| 11,633,050 | B1 | 4/2023 | Delorenzo et al. | |
| 2009/0096617 | A1 | 4/2009 | Purcell et al. | |
| 2015/0173526 | A1 | 6/2015 | Delgadillo | |
| 2015/0260699 | A1* | 9/2015 | Minvielle | A47J 43/0716 700/90 |
| 2016/0345753 | A1* | 12/2016 | Savinskiy | A47B 96/18 |
| 2017/0196375 | A1 | 7/2017 | Wallinder | |
| 2018/0338354 | A1 | 11/2018 | Bassill et al. | |
| 2021/0235929 | A1 | 8/2021 | Perkins et al. | |

OTHER PUBLICATIONS

"Non-Final Office Action received for U.S. Appl. No. 17/027,565, mailed on Oct. 31, 2022."
"Notice of Allowance received for U.S. Appl. No. 29/708,816, Mailed on Apr. 6, 2022."
"Notice of Allowance received for U.S. Appl. No. 17/027,565, Mailed on Mar. 13, 2023."
"Unified Brands, Inc.; Randell Cheese and Sauce Station Brochure; Jul. 2015; USA".

* cited by examiner

REFRIGERATED PREPARATION TABLE SYSTEM AND METHODS THEREOF

CROSS-REFERENCE TO RELATED APPLICATIONS

This application is a continuation application of co-pending U.S. patent application Ser. No. 17/027,565, filed Sep. 21, 2020, which claims priority pursuant to 35 U.S.C. 119(e) to U.S. Provisional Patent Application Ser. Nos. 62/903,610, filed Sep. 20, 2019, and 63/080,316, filed Sep. 18, 2020, the entire disclosures of which are incorporated herein by reference.

This application also is related to U.S. Design Patent Application No. 29/708,816, filed Oct. 9, 2019, now U.S. Pat. No. D960,641, the entire disclosure of which is incorporated herein by reference.

FIELD OF THE INVENTION

The present invention relates generally to food preparation. More specifically, the present invention is concerned with a system and method for preparing food ingredients on a work surface above the food ingredient container(s).

BACKGROUND

As depicted in FIGS. 1A-C, typical preparation equipment work surfaces are designed for left to right or right to left movement of the food product during the building/preparation process. Current preparation equipment requires operators to reach over the preparation work area to access food ingredient containers. The ingredient containers are located in an opening below the work surface plane or elevated above the surface. Reaching for the ingredients often is ergonomically difficult.

Most conventional preparation equipment does not include provisions to reclaim spilt ingredients and therefore the ingredients are discarded as waste. This is particularly problematic in the context of spilt cheese during pizza preparation, as cheese is the most expensive ingredient in a pizza. A worker at a pizza preparation station is required to broadcast large amounts of shredded cheese over the entire surface of the pizza. Aa a result, excess cheese is often spilt over the edges of the pizza during preparation. Some preparation equipment will include grated work surfaces with bins below to catch spilled ingredients. Nevertheless, in most conventional equipment, those bins are not refrigerated, and the spilled ingredients still are discarded. In equipment in which the bins are refrigerated the ingredients are able to be reused; however, the operator must remove the bins and redistribute the ingredients into the source containers requiring that a worker repeat this process often throughout the daily food preparation process.

In some food preparation environments, it is desirable to weigh ingredients. For example, due to the high cost of cheese in pizza, some establishments weigh the amount of cheese applied to each pizza being prepared to increase cost efficiency. Current weigh scales typically are not integrated into the work surface and requires the operator to lift the food product to dedicated scale to weigh the product. This is an additional step slowing down the process of prepping food. Accidental spillage of the product also is possible because it is not supported adequately, or simply due to the lifting and/or mishandling of the product. Such spillage typically requires a remake, resulting in added time and costs.

Accordingly, there is a need to provide a food preparation employee/operator easy accessibility with improved ergonomics to the ingredients container located directly in front of them. Moreover, there is a need for a design which allows excess ingredients that spill off the container or product on the work surface to fall through the grated work surface and back into the source ingredient bin to be saved and reused, thereby minimizing food waste and lowering food costs. Even still, there is a need for a movable grated work surface which allows the operator to adjust the location of the food product to be prepared towards or away from their body, which further allows the operator improved ergonomic process positions and enables continued movement left or right to the next stage for completion of the recipe.

In current preparation equipment, lifting and returning the product to the original work surface disrupts the flow, slowing down the process, and also may cause accidental spillage requiring remaking the product. Accordingly, another need is an integrated weigh scale that allows the operator to monitor and adjust the portion amount of the ingredients required to complete the recipe for the final product at the same level of the working prep surface, eliminating the need to lift product off the plane of the work surface and then returning to the work surface after weighed.

SUMMARY

The present invention comprises a preparation table. In some embodiments, the preparation table includes a cabinet with a work surface. The work surface includes a perimeter which defines a cavity, the cavity being configured to house an ingredient bin. The work surface further includes a grate resting on opposing guides. In some embodiments, the grate is configured such that a product container is able to rest on the grate. The cabinet and grate are structured/configured such that the product (or product container) is adequately supported by the grate, while at the same time providing suitable access for a user to reach into the cavity, retrieve one or more ingredient, and place the ingredient on the product/container. Advantageously, this provides easy accessibility with improved ergonomics to the ingredients container located directly in front of the user. Furthermore, the cabinet is configured such that excess ingredients which fall from the product container or product on the work surface fall through the grated work surface and back into the source ingredient bin to be saved and reused minimizing food waste and lowering food costs.

In some embodiments, the grate is movable between a rear position and a forward position, thereby allowing the user/operator to selectively increase or decrease an opening between the grate and the cabinet nearest the user, to allow the user to easily access the ingredients within the cavity/bin. In other embodiments the grate is stationary, and a fixed opening is defined within the grate, and/or between the grate and cavity, which fixed opening provides suitable access by the user into the cavity. The ratio of the size of the opening compared with the size of the grate is such that the user is provided suitable access to the cavity and ingredients therein, while at the same time the product is adequately supported by the grate without significant risk of falling into the cavity. In some embodiments, the opening is sized smaller than the product and/or container that is being made on the grate.

In some embodiments, the grated surface is movable between a rear portion and a forward position. Advantageously, the movable grated work surface allows the operator to adjust the location of the food product to be prepared towards or away from the operator's body, which further allows the operator improved ergonomic process positions and enables continued movement left or right to the next stage for completion of the recipe In some embodiments, the cabinet and/or work surface include an integrated weigh scale. In some embodiments, the scale is configured to be tared manually, while in some embodiments the scale is configured to tare automatically. The integrated scale advantageously eliminates the need to lift product off the plane of the work surface for weighing, and then returning to the work surface after being weighed.

In some embodiments, the cabinet includes one or more transition elements. The transition elements are positioned along at least one perimeter of the work surface of the cabinet and are configured to support the weight of the product or product container as it slides across the surface of the transition element. Advantageously, the transition element reduces the need to lift the product off the plane of the work surface when transitioning the product to an adjacent work station, eliminating the stress on the user and the risk of product spoilage/loss associated with spillage of product that sometimes occurs while lifting the product from the plane of the work surface.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION

A preferred embodiment of the invention, illustrative of the best mode in which the applicant has contemplated applying the principles, is set forth in the following description and is shown in the drawings and is particularly and distinctly pointed out and set forth in the appended claims.

FIG. 1 is FIGS. 1A-C show examples of preparation equipment as is currently known in the art.

FIGS. 2A-G are perspective, front, rear, right, left, top, and bottom views, respectively, of an embodiment of a preparation table of the present invention, shown in a first configuration.

FIGS. 3A-G. are perspective, front, rear, right, left, top, and bottom views, respectively, of a top rack of the preparation table of FIG. 2.

DETAILED DESCRIPTION

Figure 1A:
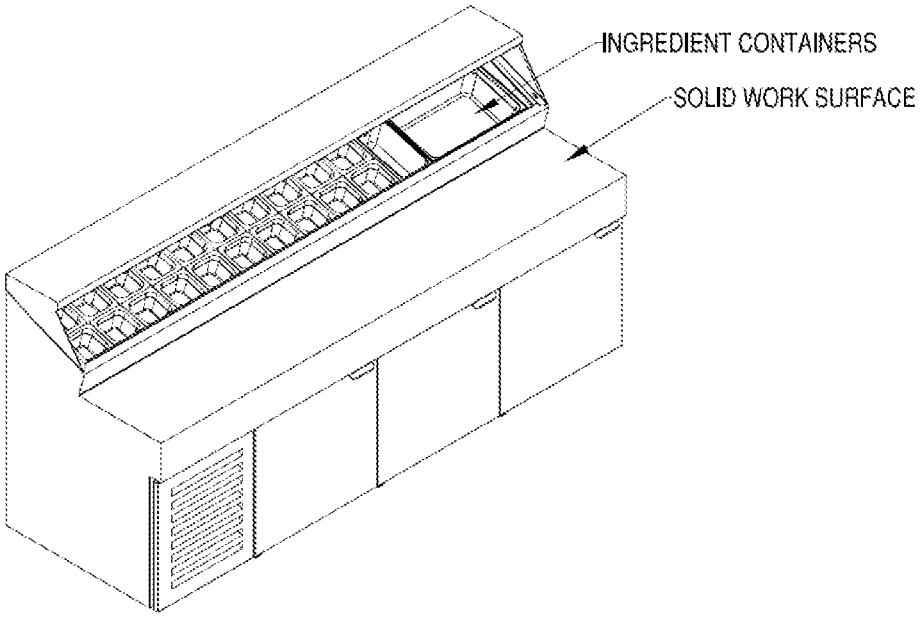
Figure 1B:
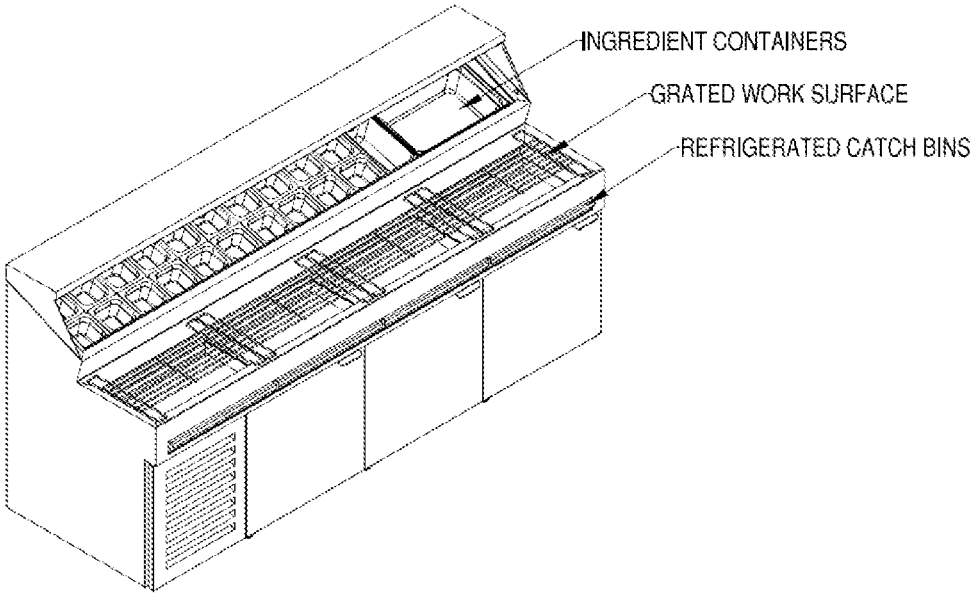
Figure 1C:
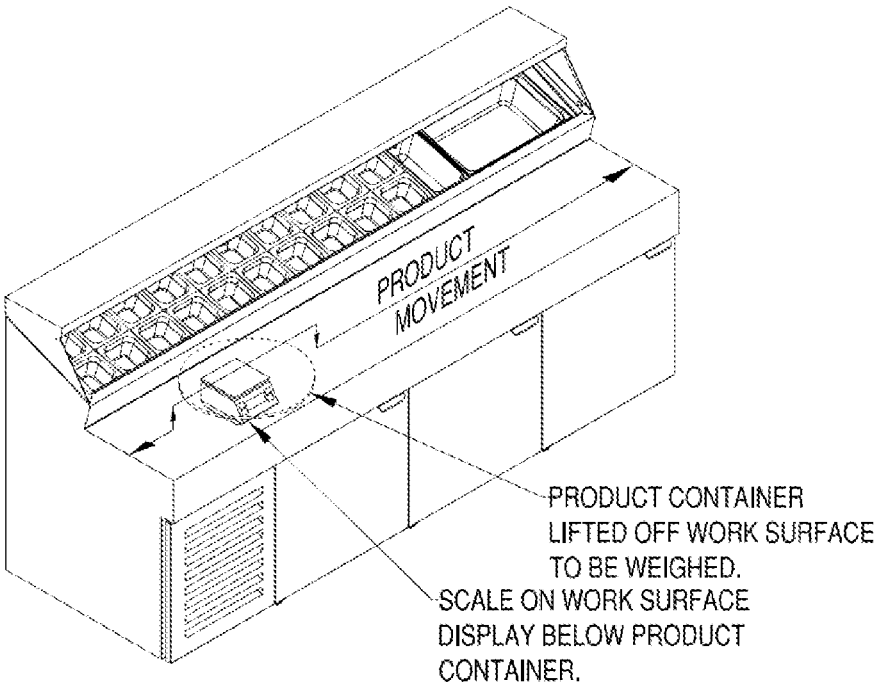
Figure 2A:
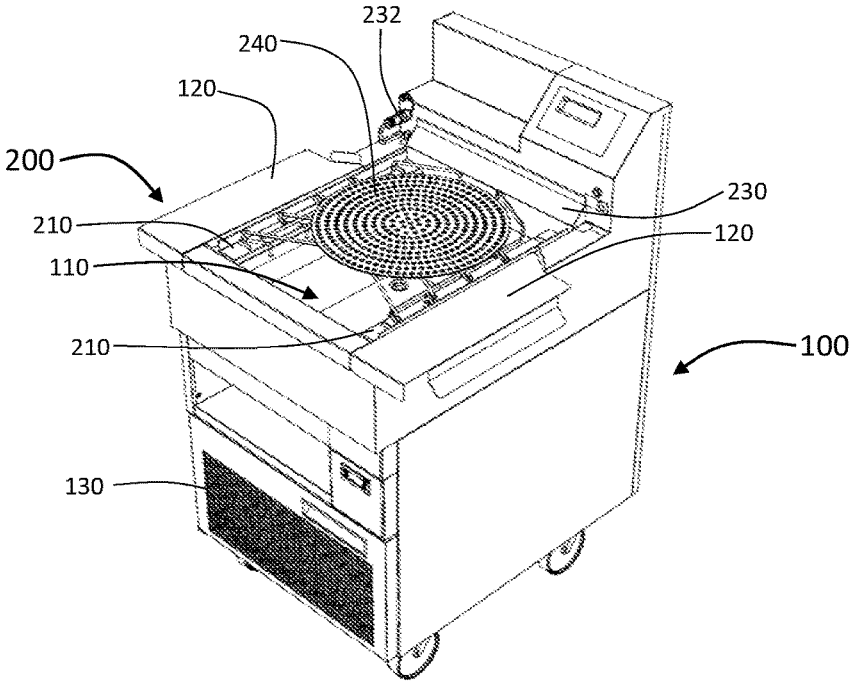
Figure 2B:
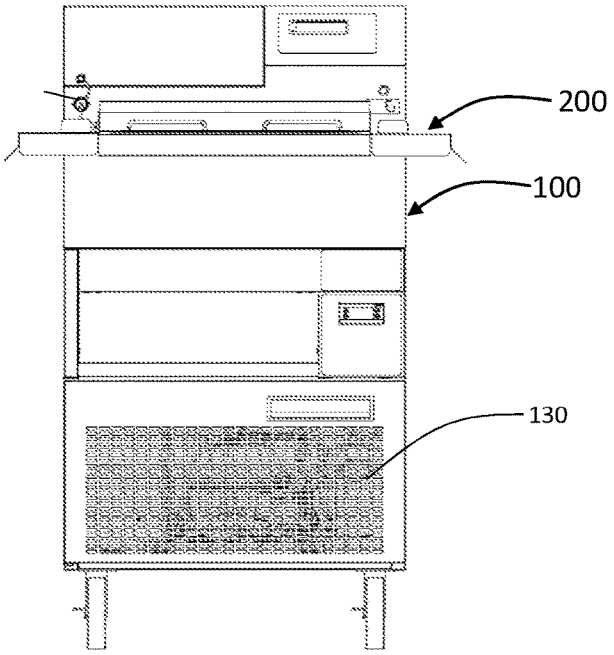
Figure 2C:
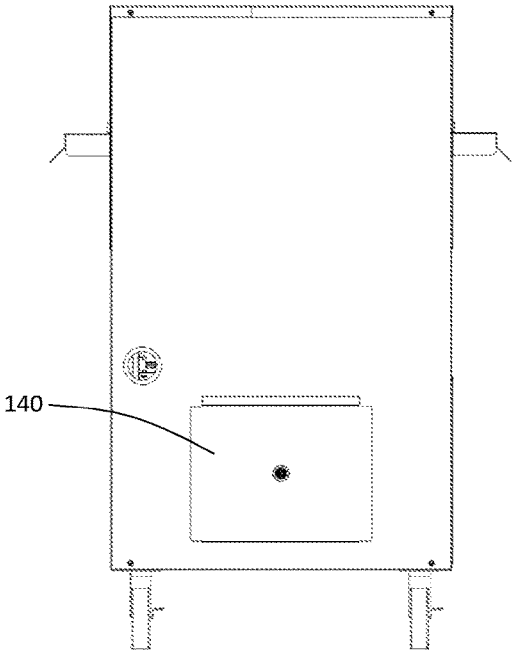
Figure 2D:
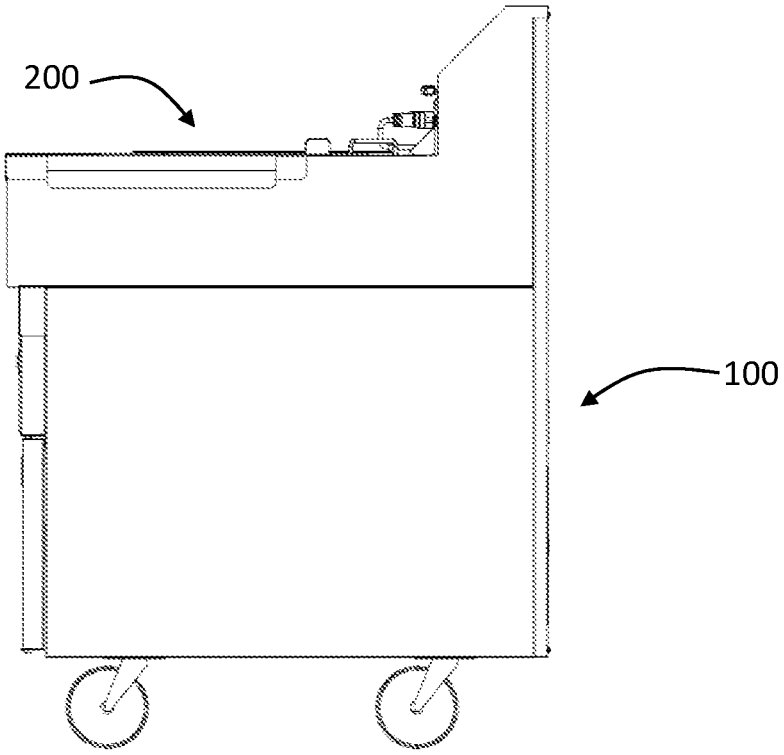
Figure 2E:
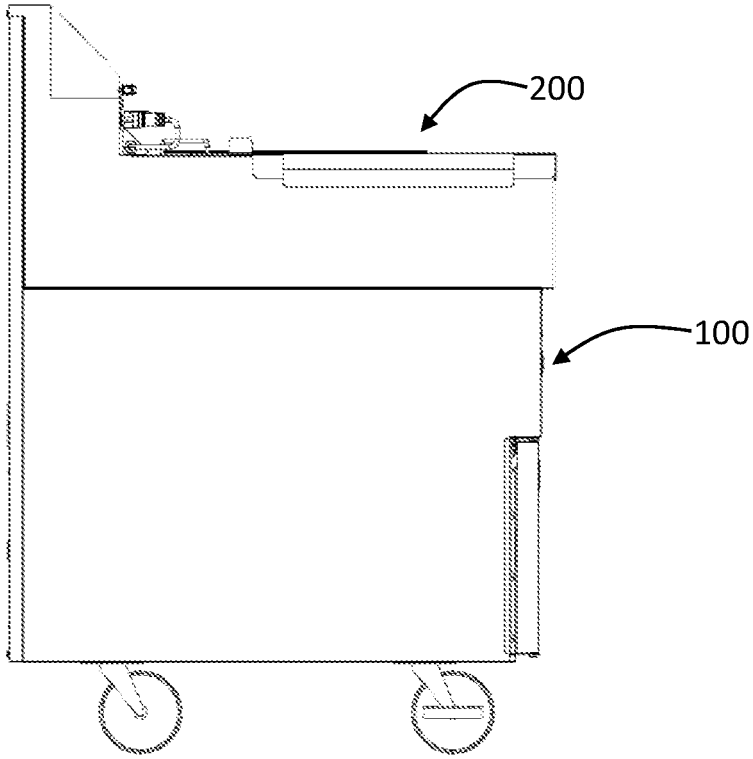
Figure 2F:
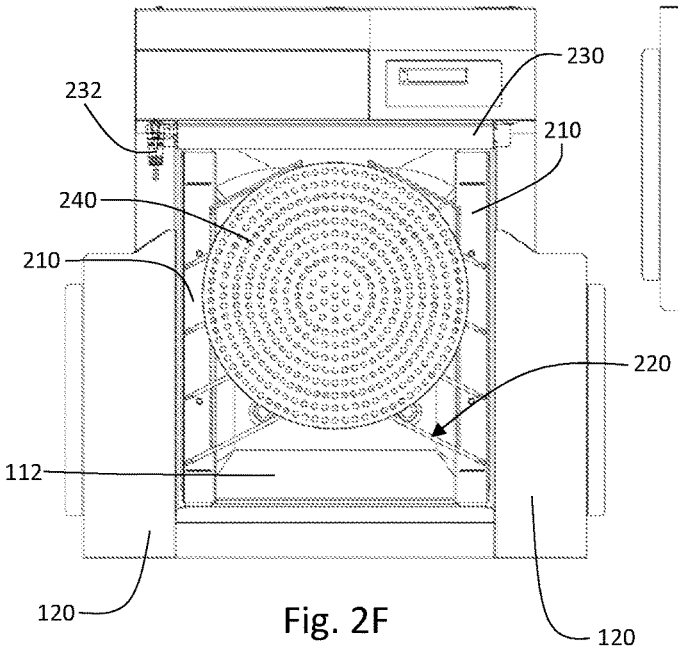
Figure 2G:
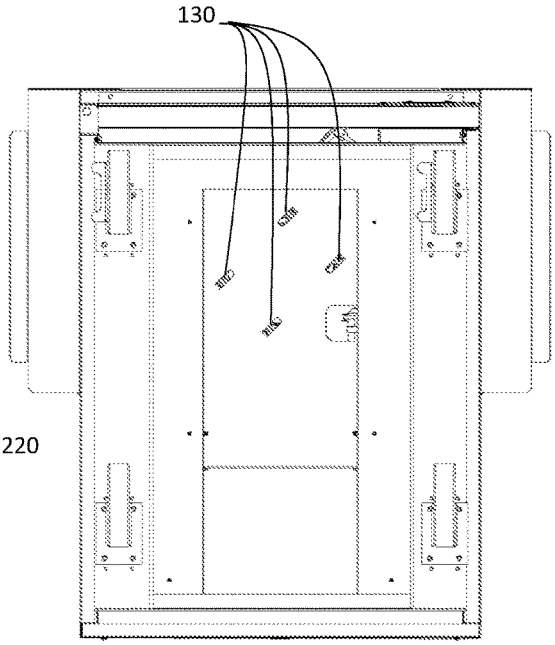
Figure 3A:
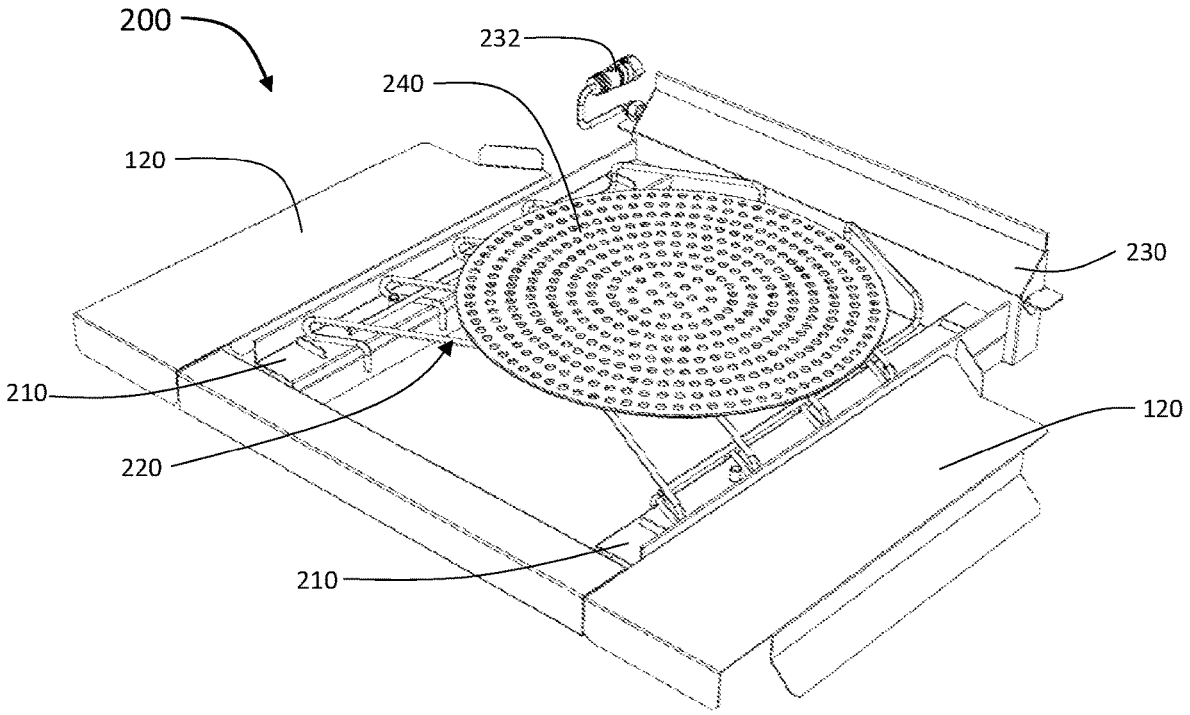
Figure 3B:
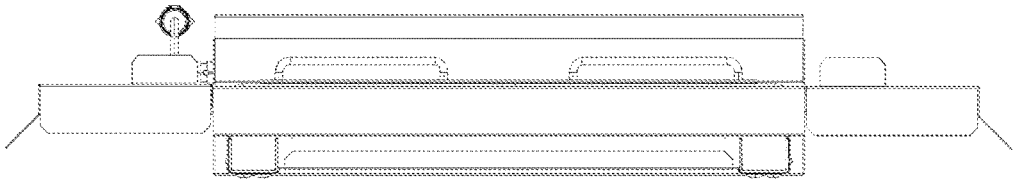
Figure 3C:
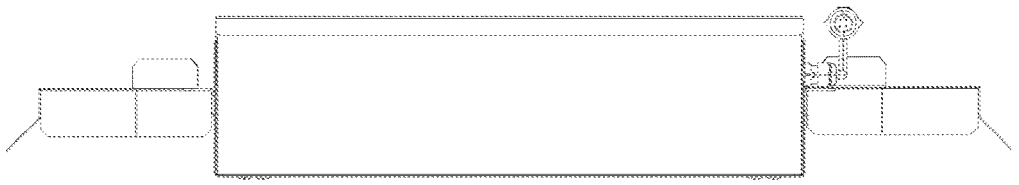
Figure 3D:
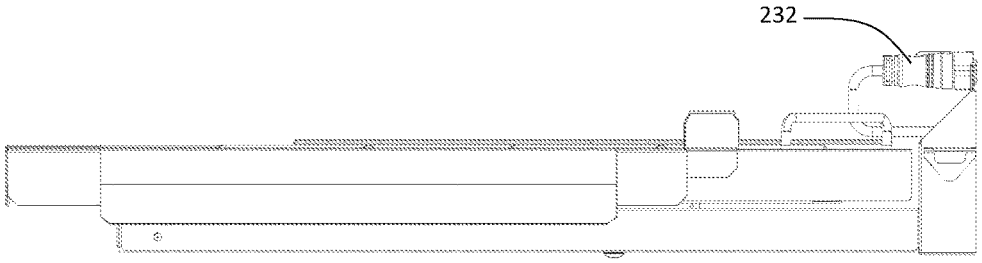
Figure 3E:
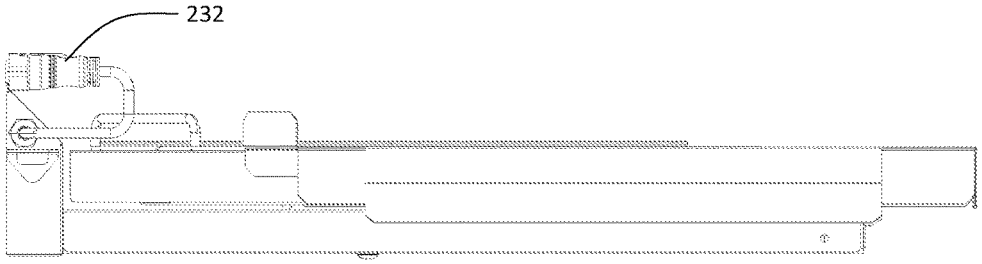
Figure 3F:
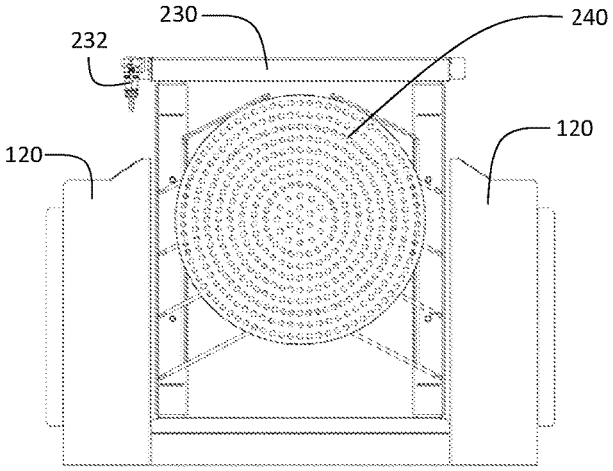
Figure 3G:
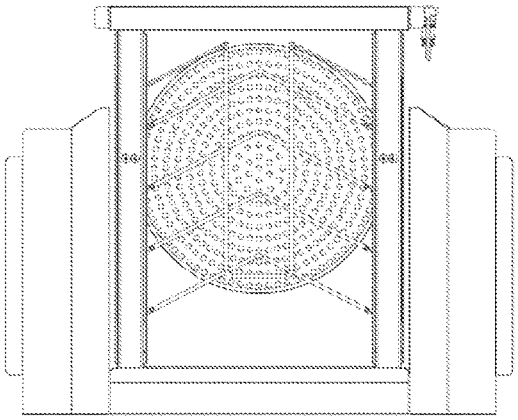
Figure 4:
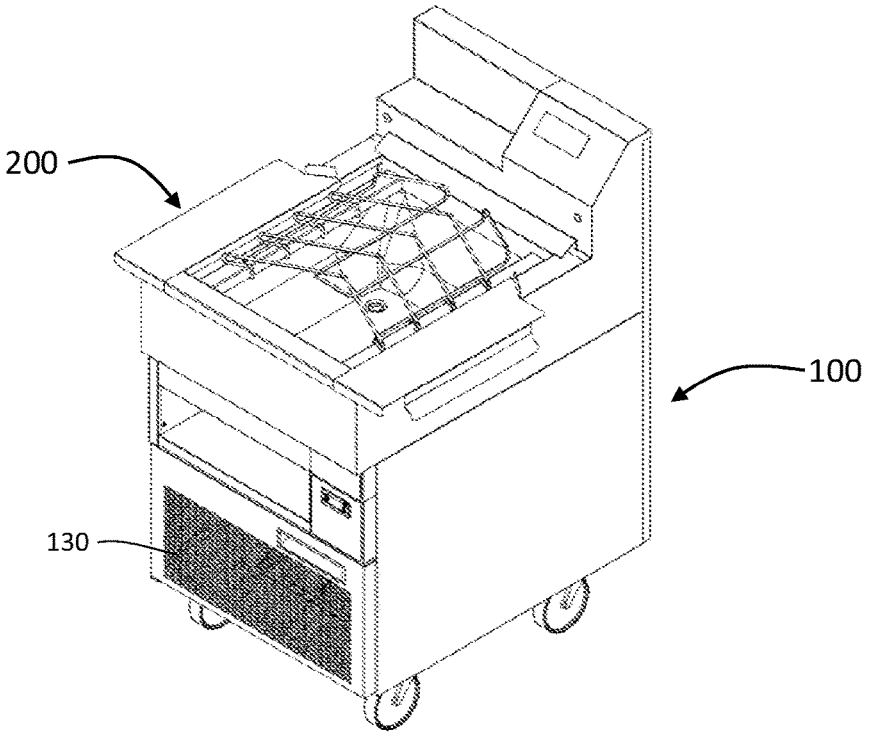
FIG. 4 is a perspective view of the preparation table of FIG. 2, shown in a second configuration.
Figure 5:
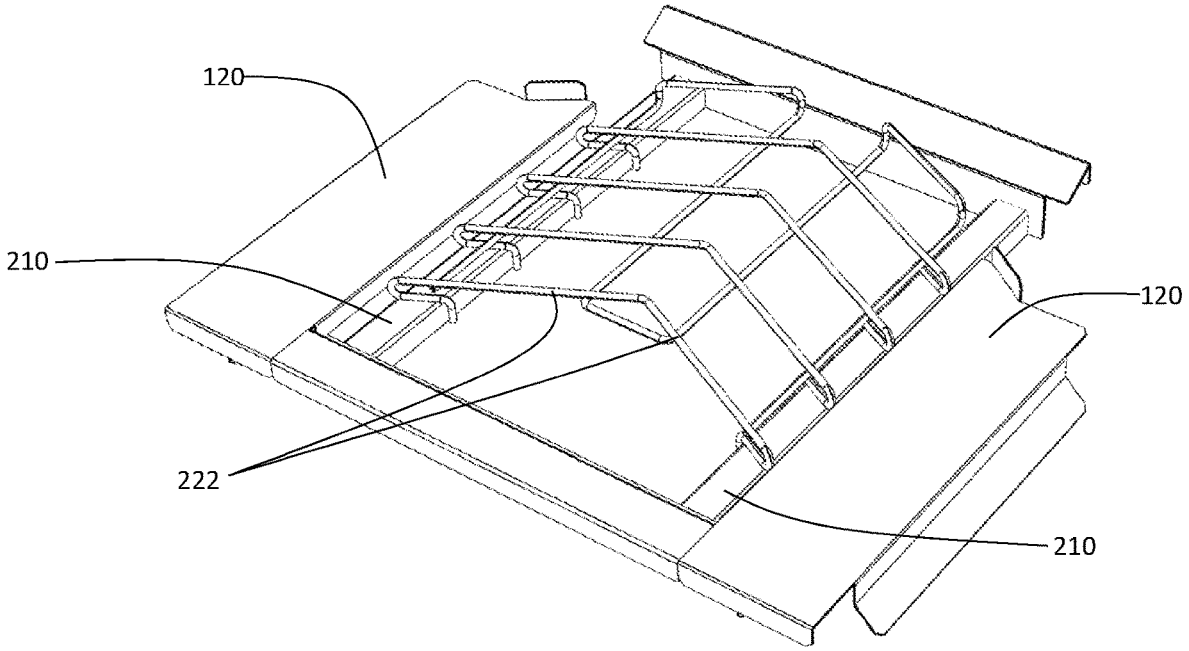
FIG. 5 is a perspective view of a top rack of the preparation table of FIG. 4.

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The present invention comprises a system for a preparation table with a grate 220 and method for preparation of a recipe utilizing such a system. In some embodiments, the preparation table is configured to allow the movement of food ingredients required to complete a recipe for consumption.

In some embodiments, the preparation table includes a cabinet 100 with a work surface 200. In some embodiments, the cabinet 100 is a stand-alone unit that is capable of being positioned adjacent to another food preparation work surface. In some such embodiments, the stand-alone unit includes a small and compact footprint that allows for retrofit into existing food preparation environments.

In other embodiments, the cabinet 100 includes the work surface 200 of the inventive concept as well as additional work surface area as desired to complete an entire recipe.

The work surface 200 of the inventive preparation table includes a perimeter which defines a central cavity 110 extending into the cabinet 100. In some embodiments, the work surface cavity 110 is configured such that the work surface is capable of receiving one or more additional surface. In some embodiments, the additional surface is an insert with interfaces with the perimetral walls of the cavity 110. In some embodiments, the inset includes opposing travel guides 210, which in some embodiments are protrusions or rails configured to receive a grate 220. In some embodiments, the guides 210 are configured to receive a grate 220 which is dimensioned at a size which is less than the entire length of the rails. In such a configuration, the grate 220 is movable along the rails towards and away a user of the preparation table, enabling a user to access the cavity 110 while also positioning grate 220 is an ergonomically favorable position. The grate 220 is configured such that a product container 240 or pan is able to rest on the grate 220.

In some embodiments, the cabinet 100 is structured to provide a work surface 200 for a person operator to prepare the ingredients or recipe towards completing a food product for consumption. In various embodiments the cabinet 100 is refrigerated, and in others it is not refrigerated, depending on food handling safety guidelines or practices. The cabinet 100 is configurable to have one or more compartments for holding various ingredients. In some embodiments, these compartments are selectively or individually refrigerated, depending on which ingredients are placed therein. The cabinet 100 also in some embodiments is adjacent to other equipment with a work surface in the same plane to continue the process of completing the recipe for the final food product.

In some embodiments, the cabinet 100 is configured with an area below the work or preparation surface 200 that holds a container or containers of food ingredients required to produce the final product. The container is configurable to be removable for storing the remaining ingredients in a designated storage location or washed to use again.

In some embodiments, an ingredient bin resides within the cavity 110 extending into the cabinet 100. In some such embodiments, the bin is a deep well bin with large holding capacity. In some embodiments, the bin is refrigerated. The ingredient bin is configurable to include one or more container. The preparation table is configured such that a user is able to reach into the ingredient bin, acquire ingredients, and apply those ingredients to the container or pan residing on the grate 220 above. Any excess ingredients that fall off the pan will subsequently fall back through the grate 220 and be recaptured by the ingredient bin. In some embodiments, the ingredient bin includes one or more sloped surface 112. This sloped surface 112 guides recaptured ingredients towards a user for easier access to the recaptured ingredients. This reduces total waste while providing the user an ergonomic way of accessing the ingredients.

In some embodiments, inserted above the ingredient container(s) is a movable grated work surface 220 area where the process of food preparation is performed. Placed on the grated work surface 220 are containers such as pans, plates, and bowls of varying materials or other foods that provides a structure to contain the ingredients through the process of completing the recipe of the final product. Examples of products include; pizza, sandwiches, salads, and a variety of food dishes requiring preparation prior to cooking or serving for consumption.

In some embodiments, the grated work surface 220 incorporates an integral weigh scale 230 to measure the amount of ingredients required. The weight of the ingredients is displayed at a location the operator can easily view the results. The weigh scale 230 includes a tare function for resetting the scale to zero for the next ingredient or next preparation of product to be produced. In various embodiments, the tare is activated by a physical touch button by hand/finger, foot or bump by any part of the body. In other various embodiments the tare is activated by movement and/or voice sensors. In some embodiments, the weigh scale 230 is programmable along with a pre-set recipe to inform the user when the correct amount of ingredients has been added.

In some embodiments, taring the scale is completed with a no-touch sensor, such as a photoelectric sensor. In such embodiments, the possibility of hand contamination is reduced. In some embodiments, an auto-taring feature is present. In such embodiments, the tare function is trigged upon certain ingredients being placed on the work surface 200. In some embodiments, the auto-tare feature is trigged upon a pre-determined weight being placed on the scale. In some embodiments, the pre-determined weight is a range of weights. In some embodiments, the auto-tare tares automatically to "0" when pizza dough and sauce on pan is placed on the scale platform. In some embodiments, weight is displayed when ingredients are added to assure accurate amount of ingredients are applied. In some embodiments, the scale automatically tares to "0" when a prepared food product or a food container is removed from the scale.

In some embodiments, the weigh scale 230 is selectively integrated within the work surface 200, such that the cabinet 100 is installed in a work environment and the weigh scale is capable of being integrated within the work surface 200 at a later time and/or easily removed from within the work surface. In some such embodiments, the weigh scale is capable of being removed and/or installed without tools, allowing for easier cleaning. In some embodiments, the integration utilizes a locking mechanism 232, such as a twist lock plug. In some embodiments, such locking mechanism 232 allows for a user to attach and remove the weigh scale 230 without the need for additional tools, facilitating efficient and economic cleaning and modularity while reducing overall downtime and training costs associated with disassembly.

In some embodiments, to access the ingredients in the container, the grated work surface 220 is configured to move to allow the operator to scoop out the estimated amount and apply to the container to hold the ingredients. In some embodiments, the open access is directly in front of the operator while the container is towards the back of the preparation table and/or grate. Ingredients are scooped from the container by hand or utensils such as cups, ladles, tongs, and spoons.

In some embodiments, once the ingredient is added the grated work surface 220 is slid towards the operator and the container slides to the next preparation stage. The motion of the container from one stage to the next is completed on the same work surface 200 plane to eliminate the need to pick up the container during the preparation process.

In some embodiments, the grated work surface 220 enables the addition of ingredients into the bin without removal of the grated work surface 220. In some embodiments, a user moves the grated work surface 220 to a first position. In the first position, a user can then access the container and add ingredients as necessary.

In some embodiments, the grated work surface 220 is stationary. In such embodiments, the grated work surface 220 is comprised of one or more structural members 222. In some embodiments, the structural members 222 are configured such that a user has access to a container within the cabinet 100 while the grated work surface 220 remains configured to support a food item during preparation. In some embodiments, the structural members 222 of the grated work surface 220 span an opening in the work surface 200. In some embodiments, the structural members 222 are bent at an angle along this span, such that the center of the structural element is displaced from an axis running from a first end of an element to a second end of the element. In some embodiments, this configuration creates a front opening in the work surface 200, such that a food item can be supported by the length of the structural element towards the edges of the span while still maintaining an opening which can be accessed by a user. In some embodiments, this opening is wedge-shaped.

In some embodiments, one or more structural members of the grated work surface 220 are spaced apart from generally parallel structural members to form the grated surface. In some embodiments, the size of the spacing is sufficient to allow individual ingredients to fall through the space created between the generally parallel structural members. At the same time, the size of the spacing is less than the size of the product being made on the grated surface, or less than the size of the container in/on which the product is being prepared, so that the product itself will not fall through the grate. This grated design, in addition to the front opening in the work surface, allows the user to easily refill the bin with ingredients without removing the grated work surface.

In some embodiments, the cabinet 100 includes one or more transition elements 120. In some embodiments, the transition elements 120 are located proximate either side of the grate 220. In some embodiments, the transition elements 120 are extended surfaces which bridge the gap between the cabinet 100 and an adjacent preparation station. In some embodiments, the transition elements 120 are operable to facilitate transition of a product or product container 240 to or from the work surface 200 while reducing the risk associated with potential gaps between the work surface 200 and another preparation station. Furthermore, the transition elements 120 increase efficiency as they eliminate the need for the user to lift a product or product container 240 to an adjacent preparation station. In some embodiments, the transition elements 120 are integrated into the work surface 200, while in other embodiments they are configured to be selectively received by the cabinet 100. In some embodiments, the transition elements 120 are selectively received and retained via a friction fit, while in other embodiments the transition elements 120 are retained via a securing means, such as a fastener, clip, adhesive, or the like.

In some embodiments, the cabinet 100 integrates one or more airflow element 130. In some embodiments, the airflow element 130 is positioned proximate the compressor, such as on a wall adjacent to a condenser. In some embodiments, the airflow element 130 allows for ambient air to flow through the cabinet 100 proximate the condenser. In some embodiments, the airflow element 130 is a grate or gap in the housing of the cabinet 100. In some embodiments, such airflow is used to manage temperatures of the condenser. In some embodiments, an additional airflow element 130 is utilized to create two opening within the cabinet 100. In some embodiments, at least one airflow element 130 is positioned on the bottom of the cabinet 100. In some embodiments, the condenser is cooled by airflow between the two airflow elements 130. In some embodiments, the condenser is cooled by airflow from the bottom of the equipment and heat is removed out the front grate. Advantageously, this airflow direction minimizes the amount of flour used in various preparation applications, namely pizza preparation, from premature failure of the condenser coil and increases longer operational life and performance.

In some embodiments, the cabinet 100 includes a clean condenser coil sensing device. In some embodiments, the device offers one or more alerts. In some embodiments, the alerts inform a user that the condensing coil is fouled and require cleaning. In some embodiments, the alters are audio/visual and are configured to be readily apparent to an operator. In some embodiments, the alert resets once the condensing coil is cleaned and proper airflow is reestablished. In some embodiments, the cabinet 100 includes a removable back panel 140, through which the condensing coils are accessed.

A method for food preparation is included. In some embodiments, the method includes placing a product container 240 on a work surface 200. The work surface 200 includes a movable grate 220, where the movable grate 220 is either already in a rear position or is moved into a rear position by a user. Where the grate 220 is not already in a rear position, the method includes moving the grate 220 to a rear position, thereby exposing a front opening to access an ingredient bin. The ingredient bin is configurable to be a single bin, or it is configurable to further contain additional containers of ingredients.

Once the grate 220 is secured in a rear position, the method includes tareing a weight sensor associated with the grate 220. In some embodiments, the weight sensor is a single, continuous cell. In other embodiments, the weight sensor is a combination of cells residing in protrusions on which the grate 220 sits upon. In some embodiments, tareing the weight sensor begins a programming routine which assists the user in building the recipe.

In some embodiments, the method then includes accessing the ingredients within the ingredient bin via the front opening. Ingredients are then added to the product container 240 until a desired amount has been reached. Excess ingredients fall from the product container 240 and through the grate 220, where they are reclaimed by the ingredient bin. Where the weight sensor indicates that too much of an ingredient has been added, the excess ingredients are capable of either being placed back into the bin or simply allowed to fall back into the bin. Once the desired ingredients have been added, the grate 220 is then moved into a forward position. Once in a forward position, the cabinet 100 is configured to then allow the product container 240 to slide off the grate 220 to either side to continue in the food preparation process.

In some embodiments, the grate 220 is stationary. In such embodiments, the grate 220 includes one or more structural members 222 configured to support the product container 240 while still presenting an opening for a user to access the ingredient bin. In some embodiments, once the desired ingredients have been added, the product container 240 is moved forward on the grate 220. In some embodiments, moving the product container 240 forward obscures the forward-most opening to access the ingredient bin. In some embodiments, once in a forward position, the cabinet 100 is configured to then allow the product container 240 to slide off the grate 220 to either side to continue in the food preparation process. In some embodiments, the cabinet 100 further includes one or more transition elements 120. In such embodiments, the transition elements 120 are positioned on either side of the work surface 200 and provide additional stability for the transition of the product container 240.

Figure 6:
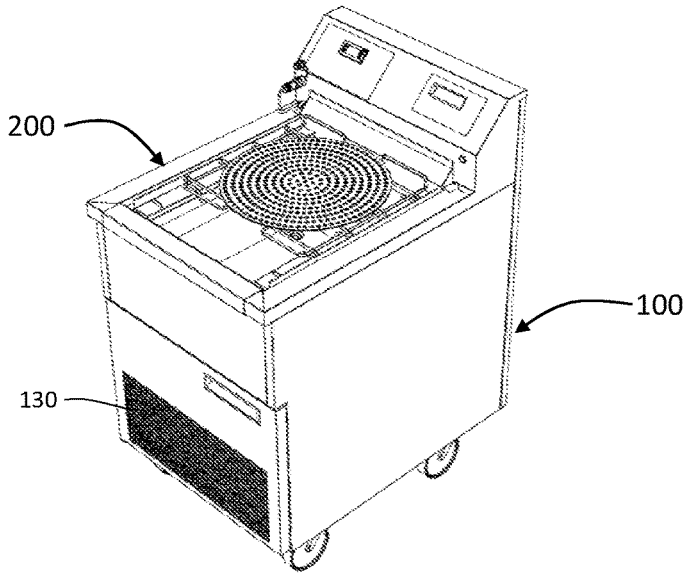
FIG. 6 is a perspective view of an embodiment of a preparation table of the present invention.
Figure 7A:
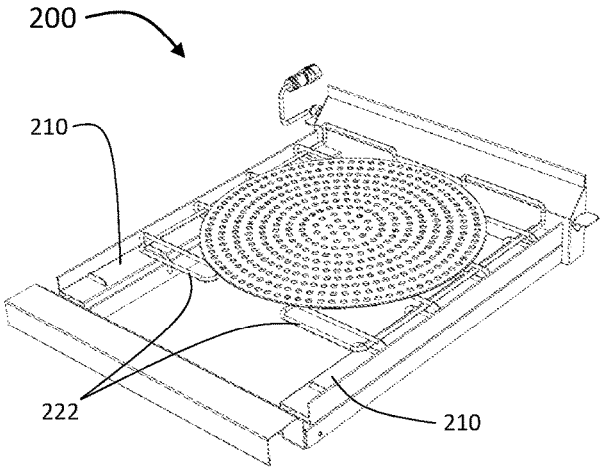
FIG. 7A is a perspective view of a top rack of the preparation table of FIG. 6, shown in a rear position.
Figure 7B:
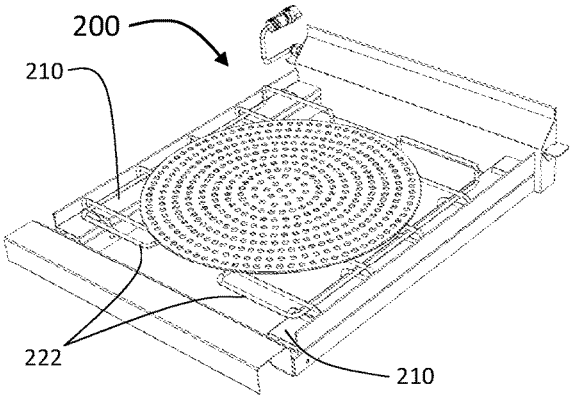
FIG. 7B is a perspective view of a top rack of the preparation table of FIG. 6, shown in a forward position.

Referring to FIGS. 6 and 7, another embodiment is depicted. In some embodiments, the work surface 200 is configured with a movable grate. In some embodiments, the movable grate is configured with one or more structural members 222 which interface with guide surfaces 210. The grate structural members are configured such that they are capable of supporting the weight of a product container while still allowing excess ingredients to pass between the structural members 222. The grate is movable between a rear position (shown in FIG. 7A) and a forward position (shown in FIG. 7B) by sliding relative to guide surfaces 210. When in a rear position, a front opening is accessible to a user of the preparation table. In some embodiments, the user accesses one or more ingredients from this opening. In some embodiments, when in a forward position, the ingredients are not accessible through the front opening. In such embodiments, the grate is still configured to allow ingredients to pass between the structural members. In some embodiments, the forward position allows a user to slide a product container resting on the grate to an adjacent preparation station without the need to lift the product container from the work surface 200, reducing the risk and effort associated with lifting the product container from the work surface 200. As shown in FIGS. 6 and 7, in some embodiments, stop members protrude upward generally perpendicularly from the guide surfaces to create limits to the movement of the grate along the guide surfaces.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

The invention claimed is:

1. A method for preparing a food item, the method comprising:

placing a product container on a work surface,
wherein the work surface includes a perimeter which defines a central cavity, and
wherein the work surface including a grate;

moving the grate along opposing travel guides to a rear position;

acquiring one or more ingredients from an ingredient bin,
wherein the ingredient bin is located in the cavity positioned below the work surface;

adding one or more ingredients to the product container; and recapturing any excess ingredients in the ingredient bin,
wherein at least some of the ingredients pass through the grate prior to recapture; and moving the grate along the opposing travel guides a forward position.

2. The method of claim 1, the step of moving the grate to the rear position, thereby exposes a front opening, the front opening being configured to provide a user to access the ingredient bin.

3. The method of claim 1, wherein the grate is dimensioned to be received by the opposing travel guides.

4. The method of claim 3, wherein the opposing travel guides are positioned proximate opposing edges of the perimeter.

5. The method of claim 1, wherein the step of moving the grate to the forward position further comprises moving the grate on the work surface after recapturing excess ingredients.

6. The method of claim 5, further comprising transferring the product container to a secondary work station by utilizing a transition element aligned with said work surface to support the weight of the product container during the transfer.

7. The method of claim 1, further comprising the step of tareing a weight sensor associated with said grate prior to adding ingredients to said product container.

8. The method of claim 1, wherein the grate comprises one or more structural members and wherein the grate is configured such that ingredients which fall from the product container pass through the grate and are recaptured by the ingredient bin.

9. The method of claim 1, wherein the ingredient bin includes a sloped surface which guides ingredients towards a user.

10. A method for food preparation, the method comprising:

placing a product container on a work surface,
wherein the work surface includes a perimeter which defines a central cavity,
wherein the work surface includes a grate, and
wherein the perimeter and grate define a front opening above the central cavity;

positioning an ingredient bin within the central cavity,
wherein the ingredient bin is configured to store one or more ingredient;

acquiring the one or more ingredient from within the ingredient bin;

applying the one or more ingredient to the product container; and recapturing any excess ingredients within the ingredient bin.

11. The method of claim 10, the step of acquiring the one or more ingredient comprises a user accessing the one or more ingredients within the ingredient bin via the front opening.

12. The method of claim 10, the step of applying the one or more ingredient to the product container comprises a user applying the one or more ingredients to the product container.

13. The method of claim 10, wherein the grate is dimensioned to be received by opposing travel guides.

14. The method of claim 13, wherein the opposing travel guides are positioned proximate opposing edges of the perimeter.

15. The method of claim 14, wherein the grate is affixed in a stationary position relative to the travel guides and wherein the grate comprises one or more structural members.

16. The method of claim 10, wherein the grate is configured such that ingredients which fall from the product container pass through the grate and are recaptured by the ingredient bin.

17. The method of claim 10, wherein the ingredient bin is configured to be removable from the central cavity.

18. The method of claim 10, wherein the ingredient bin includes a sloped surface which guides ingredients towards a user.

19. The method of claim 10, further comprising transferring the product container to a secondary work station by utilizing a transition element aligned with the work surface to support the weight of the product container during the transfer.

20. The method of claim 10, further comprising the step of tareing a weight sensor associated with said grate prior to adding ingredients to said product container.

* * * * *